United States Patent [19]

Oelsch

[11] 4,366,355

[45] Dec. 28, 1982

[54] KEYBOARD

[75] Inventor: Jürgen Oelsch, Salz, Fed. Rep. of Germany

[73] Assignee: Preh Elektrofeinmechanische Werke Jakob Preh Nachf. GmbH & Co., Saale, Fed. Rep. of Germany

[21] Appl. No.: 247,152

[22] Filed: Mar. 24, 1981

[30] Foreign Application Priority Data

Mar. 26, 1980 [DE] Fed. Rep. of Germany ..... 3011674

[51] Int. Cl.[3] ..... H01H 13/14; H01H 13/70; H01H 5/04

[52] U.S. Cl. ..... 200/159 B; 200/5 A; 200/340

[58] Field of Search ..... 200/159 B, 340, 5 A, 200/67 DA

[56] References Cited

U.S. PATENT DOCUMENTS 3,643,041 2/1972 Jackson ..... 200/159 B
4,243,861 1/1981 Standwitz ..... 200/340

FOREIGN PATENT DOCUMENTS 1806241 8/1969 Fed. Rep. of Germany .
2132329 12/1973 Fed. Rep. of Germany .
2418583 11/1974 Fed. Rep. of Germany .
2922033 12/1979 Fed. Rep. of Germany .

*Primary Examiner*—John W. Shepperd
*Attorney, Agent, or Firm*—Woodcock, Washburn, Kurtz, Mackiewicz & Norris

[57] ABSTRACT

A keyboard comprises a base plate having conductor paths and contact areas provided thereon, a plurality of keys associated with said contact areas, said keys consisting each of an elastically deformable snap member, the contact element thereof being adapted to be brought into contact with said contact areas by deformation upon actuation of an actuating button and being positioned above said contact areas in spaced relationship thereto. A metal frame is provided as mounting support for the snap members, said metal frame having a number, which corresponds to the number of snap members, of protrusions protruding therefrom in a direction toward the actuating buttons. Each protrusion has an opening therein, in which the snap member is held.

8 Claims, 5 Drawing Figures

KEYBOARD

BACKGROUND OF THE INVENTION

1. Field of the Invention

The invention relates to a keyboard.

2. Brief Description of the Prior Art

As a result of the general trend from analog to digital systems and from hardware to software, key switches are used either individually or combined to keyboards in electro-technical equipment, communication equipment and last but not least in so-called terminals or data input systems. Numerous different designs and functional principles are available for such keyboards constituting the link between man and machine. A factor of great consequence to reliability and also to the contact between man and keyboard is the type of stroke. Apart from the so-called flat-type keyboards with a stroke up to about 1.5 mm, there are also keyboards with a stroke in the range between 1.5 and 6.35 mm, depending on the practical use. In addition to this type of keyboards, of course also keyboards with contact switches are in use. However, it is a characteristic common to all stroke-type keyboards that the operator by way of tactile sensation should be given a sort of feedback that the respective key has been actuated.

A keyboard is already known which comprises a plate of insulating material having a number of holes therein superposed on a printed circuit board provided with contact areas and conductor paths. Above the plate of insulating material there is a superposed metal plate comprising a large number of embossed dome-shaped protrusions, the overall arrangement being such that these protrusions are positioned above the holes. When any of the protrusions is pressed flat, an electrical connection between the contact points of the printed circuit board can be established for the time of pressing. As soon as the pressure has been released, the protrusion snaps back into its original position. In connection with this keyboard difficulties are likely to be encountered, especially in mass production, to always obtain a stop resistance being uniform at least within the keyboard and thus an equal tactile feedback to the user.

To eliminate this disadvantage, the hemisperical contact springs in another known keyboard were designed as loosely supported, separate plate springs. The plate springs are protected against lateral yield by a supporting plate of insulating material, in the holes of which they are positioned. Under the supporting plate a further plate of insulating material is provided, which likewise has holes exposing the contact points or areas. Under this latter plate the printed circuit board with the contact points and the conductor paths is positioned. Although the tactile feedback certainly is better in the case of this keyboard, just in mass production the insertion of separate springs is more difficult from the mounting aspect and more costly than the handling of a board provided with hemispherical domes.

Furthermore a keyboard is already known, wherein snap members are positioned above a printed circuit board provided with conductor paths, said snap members consisting of a rubber-elastic material and having the shape of truncated cones. The section above the contact points of the printed circuit board is connected to the remaining part by a folding wall. The construction of the wall is such that its thickness gradually decreases from an upper section to a central section and gradually increases from the central section to a lower section which is inwardly inclined into the interior of the snap member and extends from the central section to the upper section. By deformation of the wall thus an elastic force is obtained while the operator feels a sort of snap effect.

Furthermore so-called switch mats of non-conductive silicon rubber comprising a number of dome-shaped elevations are known for keyboards. In the hollow interior of such an elevation a contact element of conductive silicon rubber is arranged, which interacts with contact areas of a printed circuit board.

Because of the amount of shrinkage being up to 6%, depending on the processing parameters among other factors, and the resulting accuracy of manufacture, these switch mats can be manufactured with sufficient accuracy of positioning of the individual functional units with respect to one another or with the required reproducibility only in specific square dimensions or lengths, respectively.

SUMMARY OF THE INVENTION

The problem underlying the present invention is to provide a keyboard of the type defined initially, which can be manufactured as a mechanically stable unit and at low cost, and in which the influence of shrinkage has been eliminated almost completely also when the dimensions are relatively large.

This problem is solved in accordance with the invention by a keyboard comprising a base plate having conductor paths and contact areas provided thereon, a plurality of keys associated with said contact areas, said keys consisting each of an elastically deformable snap member, the contact element thereof being adapted to be brought into contact with said contact areas by deformation upon actuation of an actuating button and being positioned above said contact areas in spaced relationship thereto, which keyboard is characterized in that a metal frame is provided as mounting support for the snap members, said metal frame having protrusions embossed therefrom in a direction toward the actuating buttons, the number of protrusions corresponding to the number of snap members, and in that each protrusion has an opening therein, in which the snap member is held.

BRIEF DESCRIPTION OF THE DRAWINGS

The invention will be described more specifically hereinafter with reference to embodiments and to the drawings.

DETAILED DESCRIPTION OF THE PREFERRED EMBODIMENTS OF THE INVENTION

Figure 2:
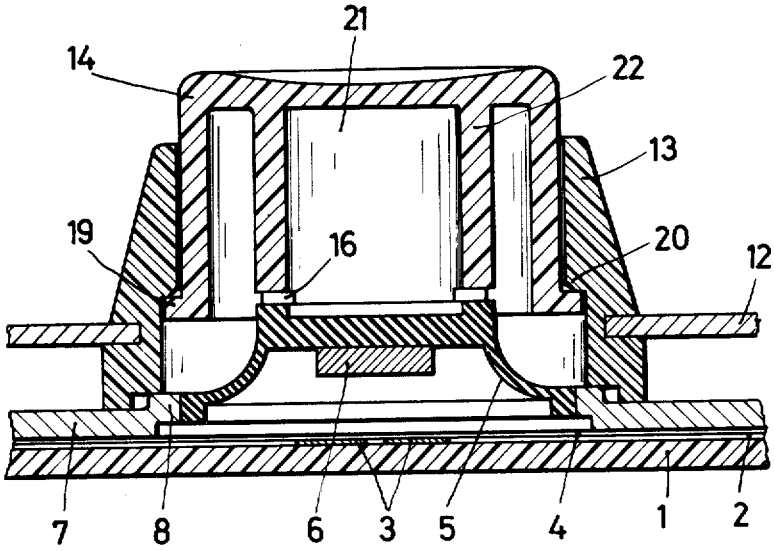
FIG. 2 is an enlarged view of the key with actuating button.

Reference numeral 1 as used in the figures denotes a base plate or foil for a keyboard of an insulating substrate such as, e.g., hard paper or plastic, on which conductor paths 2 and contact areas 3 have been provided in desired patterns by conventional techniques.

Above this base plate or foil an insulating layer or also an insulating foil or insulating plate 4 is superposed, which has recesses or cutouts at the positions of the contact areas 3. To anchor said insulating plate to the base plate, at least partial areas thereof are adhered to one another. If an insulating layer is used, this layer can be applied by screen printing. Above the insulating foil or insulating plate 4 a metal frame 7 is positioned, which has a number of embossed protrusions 8. These protrusions are interconnected by grooves 11 serving to equalize the pressure. If this possibility of equalizing pressure would not exist, the key, once pressed, no longer would return immediately into its starting position.

Each of these protrusions has a central opening 9 in which a preferably circular snap member 5 is held. This snap member is made from a rubber-elastic material, especially silicon rubber, and, as can be seen from the figures, comprises a curved edge portion which has a concave or convex curvature or may also have the shape of a truncated cone, as well as a substantially flat upper portion. The snap member functions according to the well-known snap-back principle. During manufacture all snap members are mounted in the metal frame 7 by injection molding in a single operation. Injection molding of the snap members is effected such that the openings 9 are completely closed or sealed by the snap members. By this mounting technique, combined with the adhering of the base plate, the contact areas are protected against detrimental environmental influences. On the other hand, however, this technique calls for the already mentioned equalization of pressure by means of the grooves 11. The protrusions 8 protruding from the metal frame have the function of providing a connection to the grooves 11, while the sealing effect caused by the injection molded snap members is retained.

On the underside of the snap member 5 a contact element 6 is provided, which is made from an electrically conductive material, preferably an electrically conductive silicon rubber, and which is to establish an electrical connection between the contact areas 3 when the snap member has been pressed. This contact element may be prefabricated and formed, e.g., by punching. It can be inserted prior to injection molding into the mold in cavities provided for this purpose and bonded to the subsequently injected silicon rubber by vulcanization or also by subsequent adhering to the snap member. Apart from this, manufacture and mounting of the electrically conductive contact element according to the principle of the two-color injection molding method would be feasible.

Above the metal frame 7 a cover plate 12 is placed, which may be formed of metal. As can be seen from FIG. 1, the cover plate has a plurality of supporting legs 18 bent laterally to form approximately right angles with the cover plate. These supporting legs extend through the base plate 1 and optionally through the metal frame and the insulating foil or insulating plate and have their ends projecting from the base plate interlaced. The cover plate 12 comprises a plurality of sleeve-shaped plastic supports 13, which are injection molded or snap-engaged in the cover plate. The number of the supports 13 corresponds to that of the keys.

Each support serves as guide for an actuating button 14. The actuating button may be provided with symbols on its upper face. On one of its sides the actuating button has a lateral circumferential extension 19 formed integrally therewith and abutting against a projection 20 of the support. Thereby the actuating button is secured against detachment. In the interior of the actuating button a cavity is provided, into which a sleeve-shaped wall 22 projects. With the front edge of this wall the actuating button rests on the snap member. The front edge is interrupted at some points of its circumference by small recesses 16 to guarantee equalization of pressure here as well.

Figure 1:
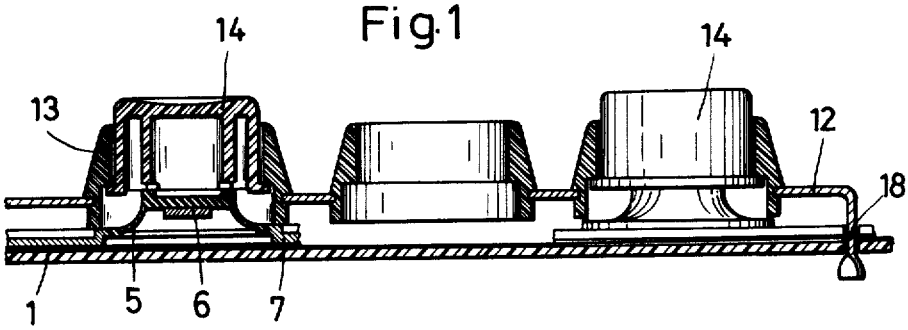
FIG. 1 is a cross-sectional view of a keyboard.
Figure 4:
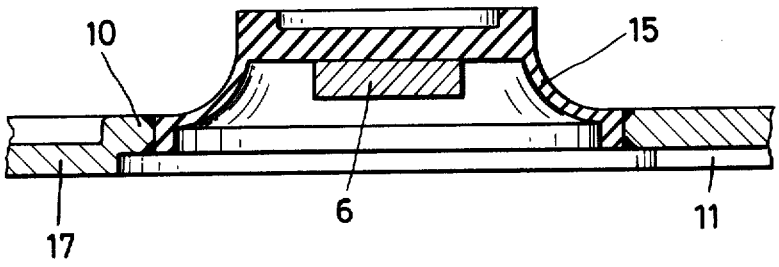
FIG. 4 is a cross-sectional view of the metal frame with injection molded snap member.
Figure 3:
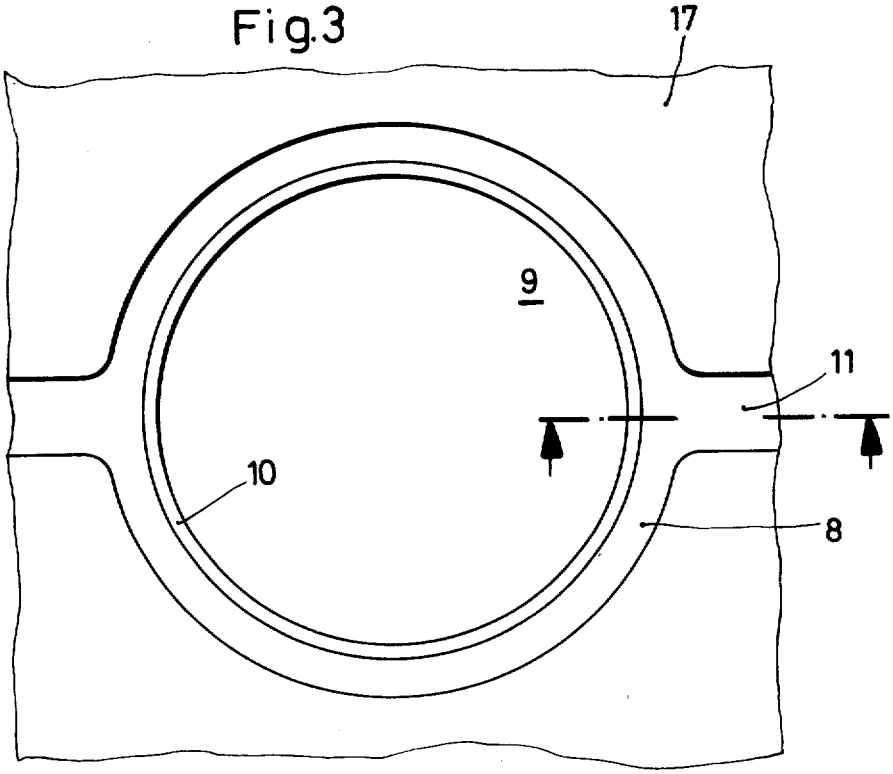
FIG. 3 shows a part of a metal frame of another embodiment.

FIGS. 1 and 2 show an embodiment, in which the edge of the opening 9 in the metal frame is smooth. FIGS. 3 and 4 show a further embodiment, in which the edge of the opening 9 on both sides has a circular chamfer 10 which is embraced by the edge portion of the snap member 15. Thereby a sort of form-locking between the metal support and the snap member is accomplished, so that the forces produced are controlled through this mechanical anchorage, with the result that a pretreatment of the metal with a bonding assistant is dispensable. The respective metal frame has been denoted by reference numeral 17 in FIGS. 3 and 4.

Figure 5:
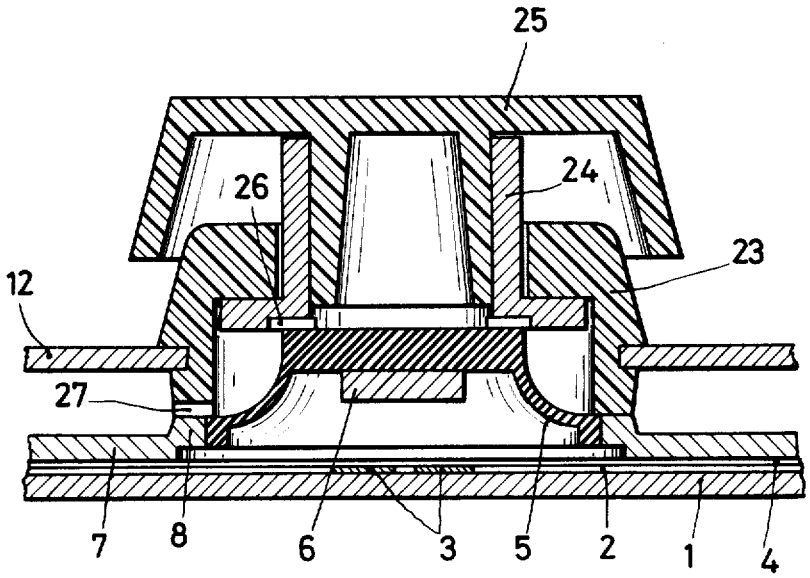
FIG. 5 is an enlarged view of a key with a different actuating button.

FIG. 5 shows another embodiment, considering especially the actuating button and its mounting. The snap member 5 and the metal frame 7, as well as the elements positioned thereunder, correspond to the embodiments already described. In this embodiment, too, a cover plate 12 of metal is present, in the holes of which a plastic support 23 has been mounted by injection molding or snap engangement. This support serves to guide an actuating button which consists of two parts in this instance, i.e. of a sleeve-shaped insert 24 and a cap member 25, which may be provided with an inscription in case of need. The cap member is secured to the insert by way of form-locking or force-locking and is slidable together with the insert. The cap member is dimensioned such as to rise above the support 23 like a roof. In case that a liquid should unintentionally get onto the keyboard, it cannot penetrate into the key guides, but will flow on the cap member 25 to the cover plate 12, where it cannot cause any damage. To allow air to escape from the cavity above the snap member, some recesses 26 and 27 are provided in both the insert and the support.

What is claimed is:

1. A keyboard comprising a base plate having conductor paths and contact areas provided thereon, a plurality of keys associated with said contact areas, said keys consisting each of an elastically deformable snap member, the contact element thereof being adapted to be brought into contact with said contact areas by deformation upon actuation of an actuating button and being positioned above said contact areas in spaced relationship thereto, characterized in that a metal frame (7, 17) is provided as mounting support for the snap members (5, 15), said metal frame having protrusions (8) embossed therefrom in a direction toward the actuating buttons (14, 24, 25), the number of protrusions corresponding to the number of snap members, and in that each protrusion has an opening (9) therein, in which the snap member (5, 15) is held.

2. The keyboard as claimed in claim 1, characterized in that the edge of the opening (9) is embraced by an edge portion of the snap member (15).

3. The keyboard as claimed in claim 2, characterized in that the edge of the opening (9) has a circular chamfer (10) on both sides.

4. The keyboard as claimed in claim 1, characterized in that the snap member (5, 15) is made from a rubber-elastic material, especially silicon rubber.

5. The keyboard as claimed in claim 1, characterized in that the snap members (5, 15) are mounted in the metal frame by injection molding in a single operation.

6. The keyboard as claimed in claim 1, characterized in that the metal frame (7, 17) has grooves (11) in the face opposite to the base plate (1), which interconnect the protrusions (8) to provide equalization of pressure.

7. The keyboard as claimed in claim 1, characterized in that the metal frame (7, 17) is common to all snap members (5, 15).

8. The keyboard as claimed in claim 1, characterized in that an actuating button (14, 24, 25), which may be provided with symbols on its upper face, is positioned above each snap member (5, 15).

* * * * *